US008702572B1

(12) United States Patent
Chalk

(10) Patent No.: US 8,702,572 B1
(45) Date of Patent: Apr. 22, 2014

(54) EXERCISE RING

(76) Inventors: Daniel Francis Chalk, Fairfax Station, VA (US); Christine Chalk, legal representative, Fairfax Station, VA (US)

( * ) Notice: Subject to any disclaimer, the term of this patent is extended or adjusted under 35 U.S.C. 154(b) by 224 days.

(21) Appl. No.: 12/927,273

(22) Filed: Apr. 8, 2011

(51) Int. Cl.
*A63B 21/22* (2006.01)
*A63B 21/06* (2006.01)
*A63F 7/00* (2006.01)

(52) U.S. Cl.
USPC ..... 482/93; 482/110; 446/266

(58) Field of Classification Search
USPC ..... 482/110, 132, 44, 45, 148, 93, 139; 446/266, 28
See application file for complete search history.

(56) References Cited

U.S. PATENT DOCUMENTS 3,306,612 A * 2/1967 Rosen ..... 273/440
3,332,166 A * 7/1967 Alexander ..... 446/431
3,545,121 A * 12/1970 Misko ..... 446/486
3,946,518 A * 3/1976 Ylitalo ..... 446/266
4,018,444 A * 4/1977 Chew et al. ..... 273/109
4,052,982 A * 10/1977 Ozeryansky ..... 601/121
4,221,074 A * 9/1980 Gonzalez ..... 446/28
5,342,273 A * 8/1994 Plendl et al. ..... 482/126
5,895,309 A * 4/1999 Spector ..... 446/220
6,949,036 B2 * 9/2005 Ciesar et al. ..... 473/457
7,303,458 B1 * 12/2007 Wolfinbarger ..... 446/236
2007/0005395 A1 * 1/2007 Singh ..... 705/2
2010/0029446 A1 * 2/2010 Munoz et al. ..... 482/78
2012/0157272 A1 * 6/2012 Kessler ..... 482/110

* cited by examiner

*Primary Examiner* — Stephen Crow
(74) *Attorney, Agent, or Firm* — Lowe Hauptman & Ham, LLP

(57) ABSTRACT

The nature of this invention is that it is an exercise ring and accessory wand that is twirled by the wrist, ankle or with wand to strengthen various body parts. The ring weighs one to twenty pounds, has an inside diameter of 8-18 inches, an outside diameter of 10-20 inches and is one to two inches thick depending on design and materials. The wand has two knobs for retaining the ring as it is twirled by hand and is one inch thick and 12 to 18 inches long.

7 Claims, 4 Drawing Sheets

EXERCISE RING

FIELD

The present description regards an exercise ring for body strengthening exercises and use thereof.

BACKGROUND OF THE INVENTION

This invention relates to a weighted exercise ring developed initially to strengthen the shoulders of patients who had rotator cuff surgeries. It had not been used in any related applications before this. After observing the rapid progress in strength in the subjects using the original exercise ring, which was a plastic tube filled with copper BB's and covered with plastic foam, it was decided to patent this invention and expand the types of composition, weight, and utilization to strengthen other body parts.

SUMMARY OF THE INVENTION

The object of this invention is to provide a weighted ring that is to be used as an exercise device to strengthen the body and provide aerobic exercise.

The size, design and weight of the ring is such that it can be swung or twirled around the arm or leg in a convenient strengthening exercise.

DESCRIPTION OF THE SPECIFICATIONS OF THE VARIOUS COMPONENTS AND VARIATIONS OF THE EXERCISE RING

Composition of the Ring

The ring's composition may be of solid, layered or hollow material that may be filled with weighted materials.

If the ring is hollow, it can be constructed of rubber, plastic, a rubber or plastic foam, or metal with a plastic, rubber, or foam covering. It may be filled inside with materials such as water, sand, or metal pellets of various amounts and weights.

If the ring is layered, the outer ring may be composed of rubber, synthetic plastic, rubber roam, plastic, or rubber coated metal. The inner space may be a plastic or metal tube filled with metal pellets, hard rubber, or sand.

If layered, the inner core may also be of a solid substance such as metal. This could be steel, brass, copper, aluminum or a similar alloy.

A component of the invention is an accessory wand of wood or hard plastic with 2 knobs on one end to hold the ring while the wand is used to twirl the ring for additional exercise.

Explanation and Description of the Drawings and the Specification of the Various Components of the Exercise Ring.

Figure 1:
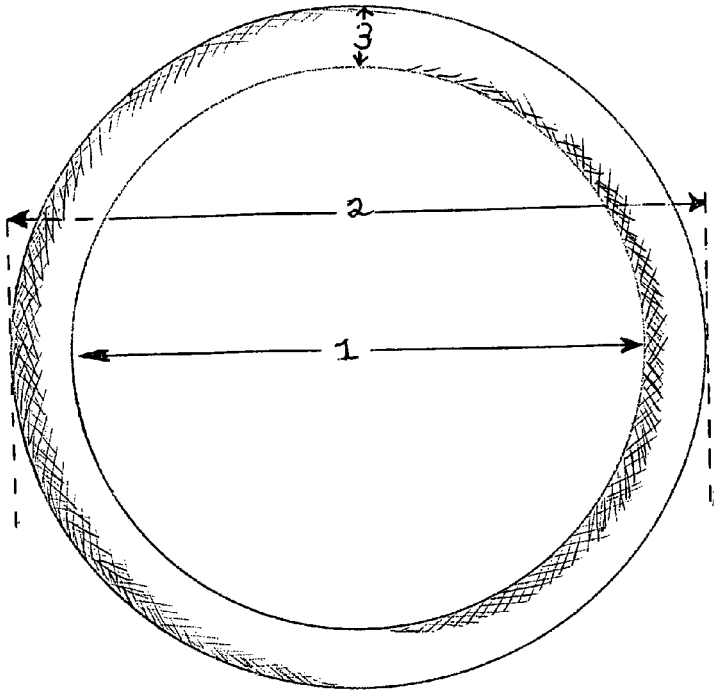
FIG. 1 is a representation of a frontal view of the ring.

FIG. 1 is a representation of a frontal view of the ring which depicts the inside diameter of eight to eighteen inches (FIG. 1, number 1) and an outside diameter of ten to twenty inches (FIG. 1, number 2).

FIG. 1, number 3 is a representation of the diameter of the thickness of the ring which varies from one to two inches.

Figure 2:
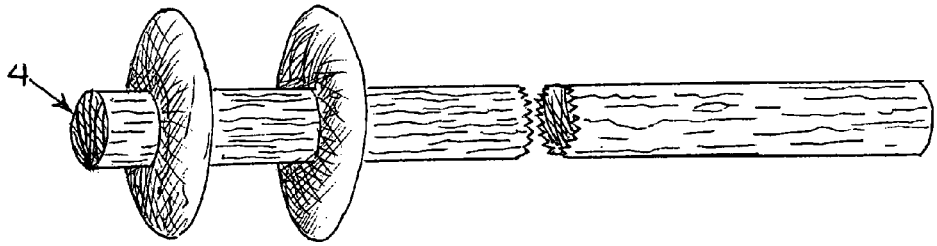
FIG. 2 is a representation of a view of the ring.

FIG. 2 is a representation of a slightly angled and fragmented view from the side of the wooden accessory wand, which is 12 to 18 inches in length and one inch thick in diameter (FIG. 2, number 4).

Figure 3:
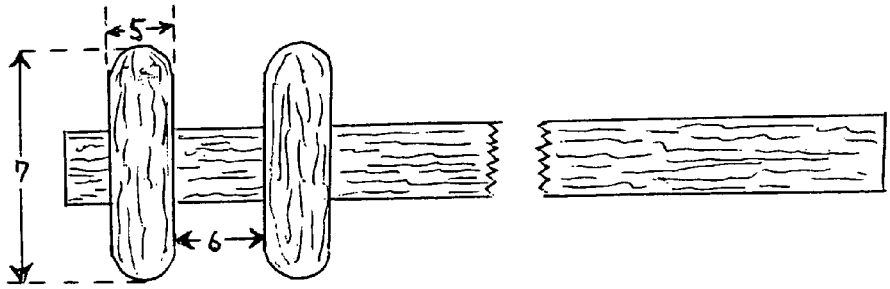
FIG. 3 is a representation of a view of the wand.

FIG. 3 is a representation of a fragmented side view of the wand displaying 2 knobs to 1 inch thick (FIG. 3, number 5), 2-3 inches apart (FIG. 3, number 6) and 3 to 4 inches in diameter (FIG. 3, number 7).

The wand may be constructed of wood or hard plastic.

Figure 4:
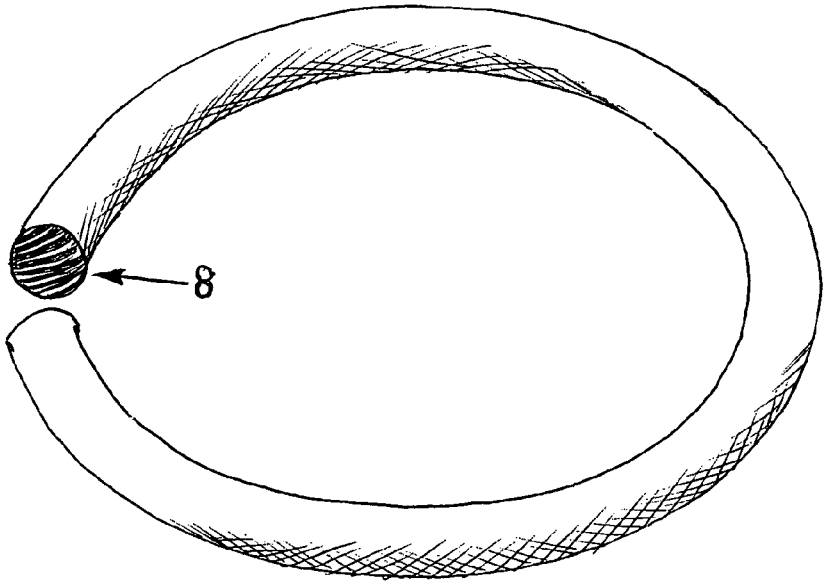
FIG. 4 is a representation of a view of the ring.

FIG. 4 is a representation of an angled view of the ring that has had a section removed displaying the thickness of the ring, 1-2 inches in diameter (FIG. 4, number 8).

Figure 5:
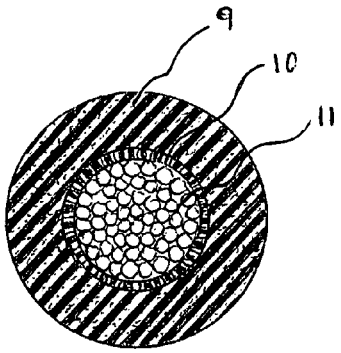
FIG. 5 represents a cross-section of the ring.

FIG. 5 represents a cross-section of the ring 1.5 inches in diameter.

FIG. 5, number 9 represents the outer layer of plastic or rubber foam.

FIG. 5, number 10 represents an inner core, approximately ½ inch in diameter, made of metal such as steel, brass or copper.

Figure 6:
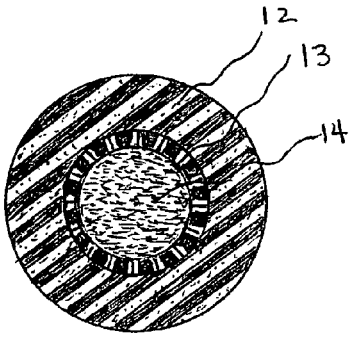
FIG. 6 represents a cross-section of the ring.

FIG. 6 represents a cross-section of the ring with an outer layer of rubber or plastic foam (number 11), with a plastic tube (number 12), filled with small copper, tungsten or other metal balls or BB's (FIG. 13) for added weight.

Figure 7:
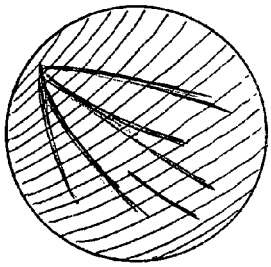
FIG. 7 represents a cross-section of the ring.

FIG. 7 represents a cross-section of the ring with a rubber or plastic foam outer layer (number 14}, and an inner plastic tube (number 15) filled with sand (number 16).

Figure 8:
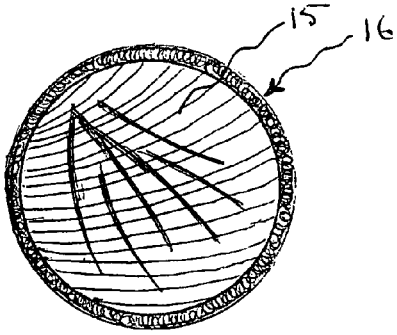
FIG. 8 represents a cross-section of the ring.

FIG. 8 represents a cross-section of the ring with an outer layer of rubber (number 17), covering a metal tube (number 18), which may be filled with any kind of metal pellets of substances such as sand.

FIG. 8 cross-section may be of one solid ring of rubber.

Figure 9:
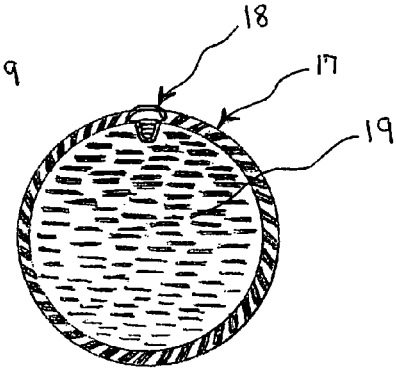
FIG. 9 represents a cross-section of the ring.

FIG. 9 represents a cross-section of the ring of solid rubber.

Figure 10:
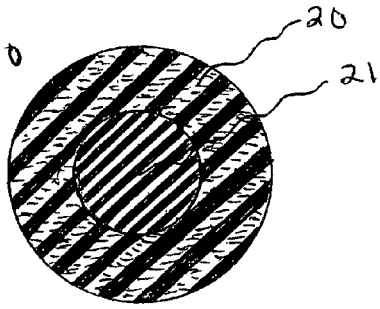
FIG. 10 represents a cross-section of the ring.

FIG. 10 represents a cross-section of the ring made of solid wood.

Figure 11:
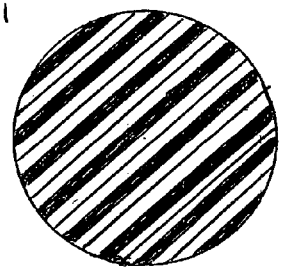
FIG. 11 represents a cross-section of the ring.

FIG. 11 represents a cross-section of the ring with an outer layer of rubber or vinyl (number 19) covering a solid wood core (number 20).

Figure 12:
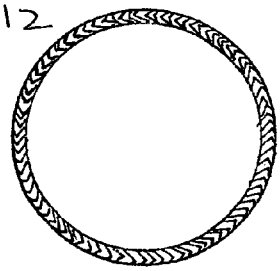
FIG. 12 represents a cross-section of the ring.

FIG. 12 represents a cross-section of the ring with an outer layer of rubber or plastic (number 22), with a removable plug (number 21), filling a hole in the hollow ring which may be filled with water or gel (number 23).

Figure 13:
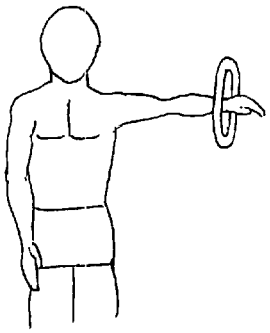
FIG. 13 represents a cross-section of the ring.

FIG. 13 represents a cross-section of the exercise ring with an outer layer of rubber or flexible plastic with an inner core of packed sand.

Figure 14:
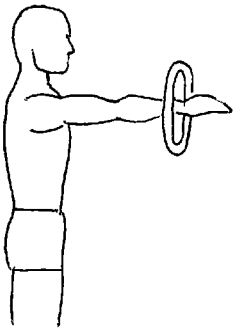
FIG. 14 represents a cross-section of the ring.

FIG. 14 represents a cross-section of the ring with an outer layer of rubber of flexible plastic filled with metal balls or BBs.

Figure 15:
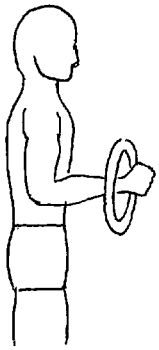
FIG. 15 represents a cross-section of the ring.

FIG. 15 represents a cross-section of the ring with an outer layer composed of rubber foam or plastic foam with an inner core of packed sand.

Figure 16:
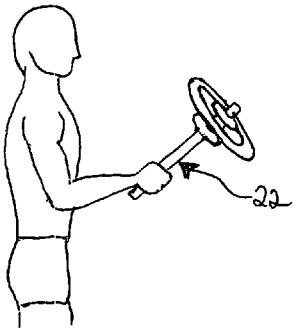
FIG. 16 represents a cross-section of the ring.

FIG. 16 represents a cross-section of the ring with an outer layer of rubber foam or plastic foam filled with metal balls or BBs.

Description of the Illustrations Demonstrating Utilization of the Flexible Ring

Figure 17:
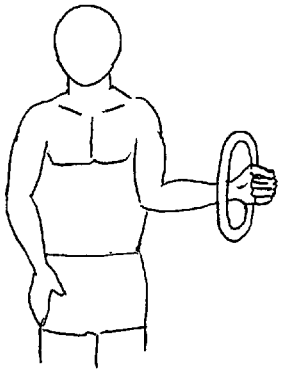
FIG. 17 represents the subject twirling the ring.

FIG. 17 represents the subject twirling the ring at the wrist at 90 degrees of shoulder abduction.

Figure 18:
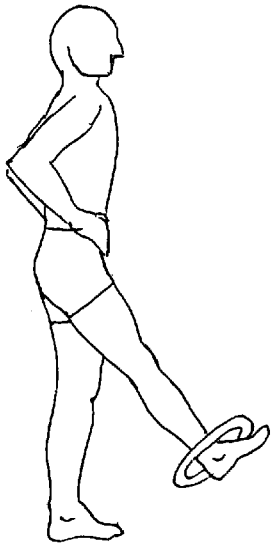
FIG. 18 represents the subject twirling the ring.

FIG. 18 represents the subject twirling the ring at the wrist with the arm at 90 degrees of flexion.

Figure 19:
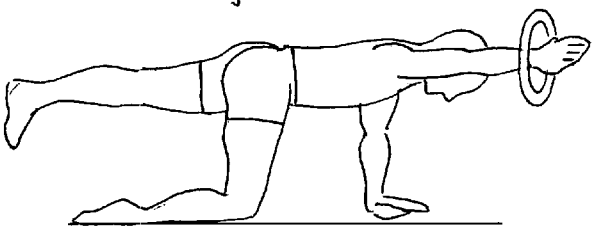
FIG. 19 represents the subject twirling the ring.

FIG. 19 represents the subject twirling the ring at the wrist the elbow flexed.

Figure 20:
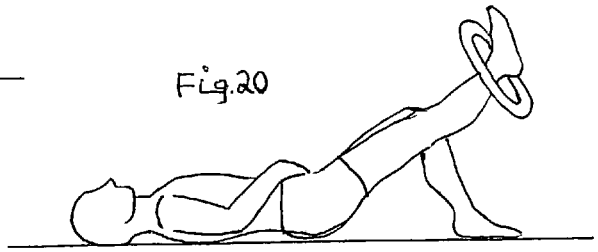
FIG. 20 represents the subject twirling the ring with the accessary wand.

FIG. 20 represents the subject twirling the ring with the accessary wand.

The invention claimed is:

1. An exercise system, comprising a ring having a thickness ranging from one to two inches, having an inside diameter ranging from eight to eighteen inches and having an outside diameter ranging from ten to twenty inches; and a wand configured to hold the ring while the wand is used to twirl the ring; and wherein the exercise system is useable for the rehabilitation of a patient having rotator cuff surgery; wherein the wand has, on one end, two knobs having a thickness of about one inch, the two knobs spaced from two to three inches apart on the wand, the knobs having a diameter ranging from three to four inches, wherein the ring is configured to fit between the two knobs while being twirled about the wand for exercise; and wherein the knobs are the sole retaining structure which limits lateral movements of the ring when in use.

2. The exercise system of claim 1, wherein the ring is layered, and the outer ring layer is composed of a material selected from rubber, synthetic plastic, rubber roam, plastic, and rubber coated metal.

3. The exercise system of claim 2, wherein the inner space of the ring is a plastic or a metal tube filled with a material selected from metal pellets, hard rubber, and sand.

4. The exercise system of claim 3, wherein the metal pellets are selected from pellets of steel, brass, copper, aluminum or an alloy thereof.

5. The exercise system of claim 1, wherein the wand is plastic or wood.

6. The exercise system of claim 1, wherein the ring is hollow and constructed of a material selected from rubber, plastic, a rubber or plastic foam, and metal with a covering selected from plastic, rubber, and foam coverings.

7. The exercise system of claim 6, wherein the hollow center of the ring is filled with a material selected from water, sand, or metal pellets.

* * * * *